United States Patent [19]

Eves, II et al.

[11] Patent Number: 4,684,777

[45] Date of Patent: Aug. 4, 1987

[54] PRODUCT SUPPORT TRAY FOR MICROWAVE PROCESSING

[75] Inventors: E. Eugene Eves, II, Westford; Thomas F. Maher, Brockton, both of Mass.

[73] Assignee: Raytheon Company, Lexington, Mass.

[21] Appl. No.: 344,470

[22] Filed: Feb. 1, 1982

Related U.S. Application Data

[63] Continuation of Ser. No. 137,021, Apr. 2, 1980.

[51] Int. Cl.[4] ..... H05B 6/64

[52] U.S. Cl. ..... 219/10.55 A; 219/10.55 E

[58] Field of Search ..... 219/10.55 A, 10.55 R, 219/10.55 E, 10.55 F, 10.55 M, 10.55 D

[56] References Cited

U.S. PATENT DOCUMENTS

| | | | |
|---|---|---|---|
| 3,434,220 | 3/1969 | Forster | 219/10.55 A |
| 3,525,840 | 8/1970 | Dremann | 219/10.55 A |
| 3,718,082 | 2/1973 | Lipoma | 219/10.55 R |
| 3,846,606 | 11/1974 | Edgar et al. | 219/10.55 A |
| 3,849,623 | 11/1974 | Gilliatt | 219/10.55 R |
| 3,858,022 | 12/1974 | Smith | 219/10.55 E |
| 3,881,403 | 5/1975 | Ingram et al. | 219/10.55 A |
| 4,176,268 | 11/1979 | Gerling | 219/10.55 A |
| 4,198,554 | 3/1980 | Wayne | 219/10.55 A |
| 4,208,561 | 6/1980 | Sitzler | 219/10.55 E |
| 4,219,716 | 8/1980 | Kaufman et al. | 219/10.55 R |
| 4,225,767 | 9/1980 | Hatanaka et al. | 219/10.55 R |
| 4,329,557 | 5/1982 | Staats | 219/10.55 A |

*Primary Examiner*—E. A. Goldberg
*Assistant Examiner*—M. M. Lateef
*Attorney, Agent, or Firm*—William R. Clark; Richard M. Sharkansky

[57] ABSTRACT

A microwave oven product support tray having a rigid rectangular frame over which is attached sheets of a flexible thin material such as Teflon coated fiberglas. The attachment means may be easily removed so that damaged sheets may be replaced. The tray may be supported in the oven cavity by support rails which permit the tray to be partially pulled out of the cavity for easy loading and unloading of product.

16 Claims, 3 Drawing Figures

PRODUCT SUPPORT TRAY FOR MICROWAVE PROCESSING

CROSS-REFERENCE TO RELATED CASES

This is a continuation of application Ser. No. 137,021, filed Apr. 2, 1980.

BACKGROUND OF THE INVENTION

Microwave energy is utilized in microwave ovens to heat products placed within the oven cavity. One application of heating is the thermal processing of rubber. A tray used for product support in such an application should exhibit a plurality of desirable characteristics.

First, for example, the tray's mechanical characteristics must be compatible with an industrial rubber processing environment. More specifically, the tray should be resistant to the shock of being dropped or impact loaded. Also, it must be immune to temperatures up to 400° F. and capable of being subjected to much higher temperatures without producing toxic by-products as, occasionally, the rubber products may burn resulting in temperatures higher than 400° F. The tray should also be light and easy to handle.

Second, the tray must satisfy the constraints of microwave processing. More specifically, it must not heat in a microwave field. Also, it must be transparent to microwave energy such that it does not create significant impedance transformer characteristics to the surface of the product supported by it. It is desirable that the distribution of energy through the product be as symmetric as possible to accomplish uniformity in the heating profile. To minimize the boundary condition of the support surface, it is preferable that the material be very thin. Especially, in an oven having feeds for microwave energy at the top and bottom of the cavity, it is advantageous that the product appear to be supported in free space without impedance transformation caused by the support structure.

Third, the tray must satisfy miscellaneous requirements to be commercially successful. For example, it must be relatively inexpensive to produce and easily replaced or repaired in case of damage. Also, rubber products must not stick to the surface or combine with material; it must also be easy to clean. Finally, it is preferable that the tray provide easy access to the microwave cavity for loading and removing product.

In the prior art, products have been supported by metallic trays which may or may not be suspended from the walls of the cavity. This structure, however, has the disadvantage of not being transparent to microwave energy. Accordingly, microwave energy cannot enter the product through the supporting surface and symmetry of processing is sacrificed. Also, it is well known that metallic structures in the microwave cavity cause anomalies in the field which are difficult to predict and often reduce the uniformity of heating.

Ceramic trays were considered for the rubber processing application but they were very susceptible to breakage caused by rough handling. Furthermore, when a ceramic tray is made thick enough so as not to be so fragile, it exhibits impedance transformer characteristics at the boundary of the product which are undesirable. Also, the trays were relatively expensive.

Also considered for a tray material were a number of plastics such as polypropylene, reinforced polyesters, and polysulfone. These, however, generally had to be thicker than one-eighth of an inch to obtain the requisite strength; the required thickness impacted the impedance transformer characteristics at the boundary of the product. Primarily, these plastics are generally not suited for rubber processing environments due to temperature limitations.

SUMMARY OF THE INVENTION

The invention discloses a microwave oven cavity having a product support tray suspended horizontally therein, the tray comprising a rigid border frame substantially conforming to the shape of the oven cavity in a horizontal plane and a microwave transparent sheet attached to the frame to provide the product support surface for the tray. It may be preferable that the sheet comprises glass fibers covered with synthetic resin polymer material and the frame comprises aluminum. It is preferable that the sheet or the total thickness of sheets, if more than one is used, be relatively thin so as to minimize transformer impedance characteristics into the product.

The invention may also be practiced by a microwave oven cavity having a product support tray held in an elevated horizontal position therein by support means, the tray comprising a rigid border frame and a flexible microwave transparent material suspended across the frame to provide product support surface for the tray. It may be preferable that the tray substantially conforms to the shape of the oven cavity in a horizontal plane.

The invention may also be practiced by a microwave oven cavity having a product support tray suspended horizontally therein, the tray comprising a rigid frame having four elongated members with ends connected to form a rectangular shape and a sheet of microwave transparent material having a thickness of less than one-eighth inch covering the frame and attached to two of the members that are parallel. Preferably, the material should have a thickness of less than one-eighth inch. Also, more than one sheet of microwave transparent material may cover the frame in which case the total thickness of all layers is preferably less than one-eighth inch. The transparent material may preferably comprise glass fibers covered with synthetic resin polymer substance. Also, the frame may comprise aluminum and substantially conform to the dimensions of the cavity in a horizontal plane.

Furthermore, the invention may be practiced by a microwave oven cavity having support rails connected to the side walls in a horizontal direction with a product support tray positioned on the support rails and supported thereby wherein the tray comprises a rigid border frame and a flexible microwave transparent material suspended there across by attachment thereto. It may be preferable that the support rails comprise polypropylene.

BRIEF DESCRIPTION OF THE DRAWINGS

The objects of the invention and the following detailed description can be better understood with reference to the drawings wherein.

DESCRIPTION OF THE PREFERRED EMBODIMENT

Figure 1:
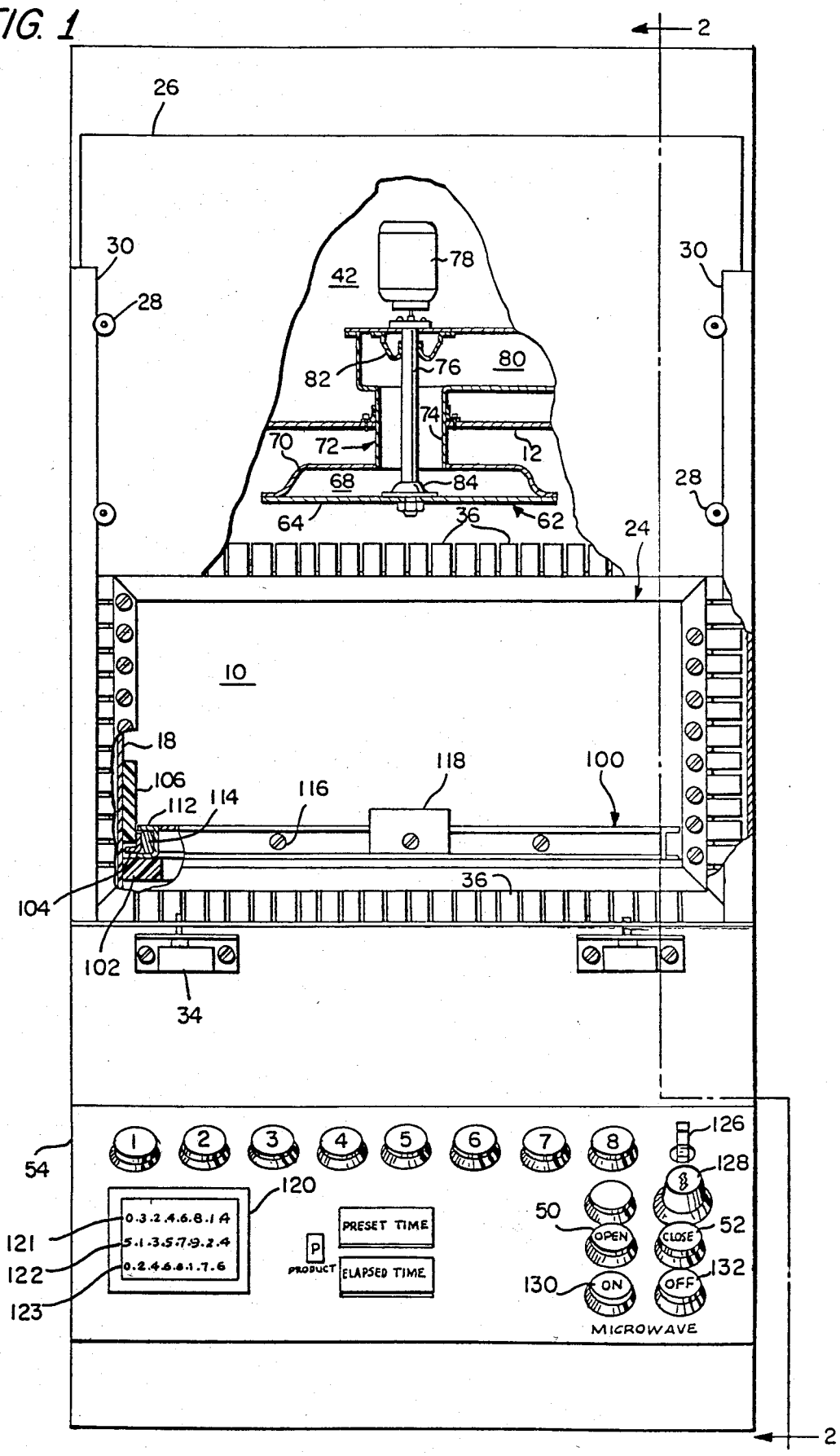
FIG. 1 is a front elevation partially cut away of a batch-type microwave oven embodying the invention.
Figure 2:
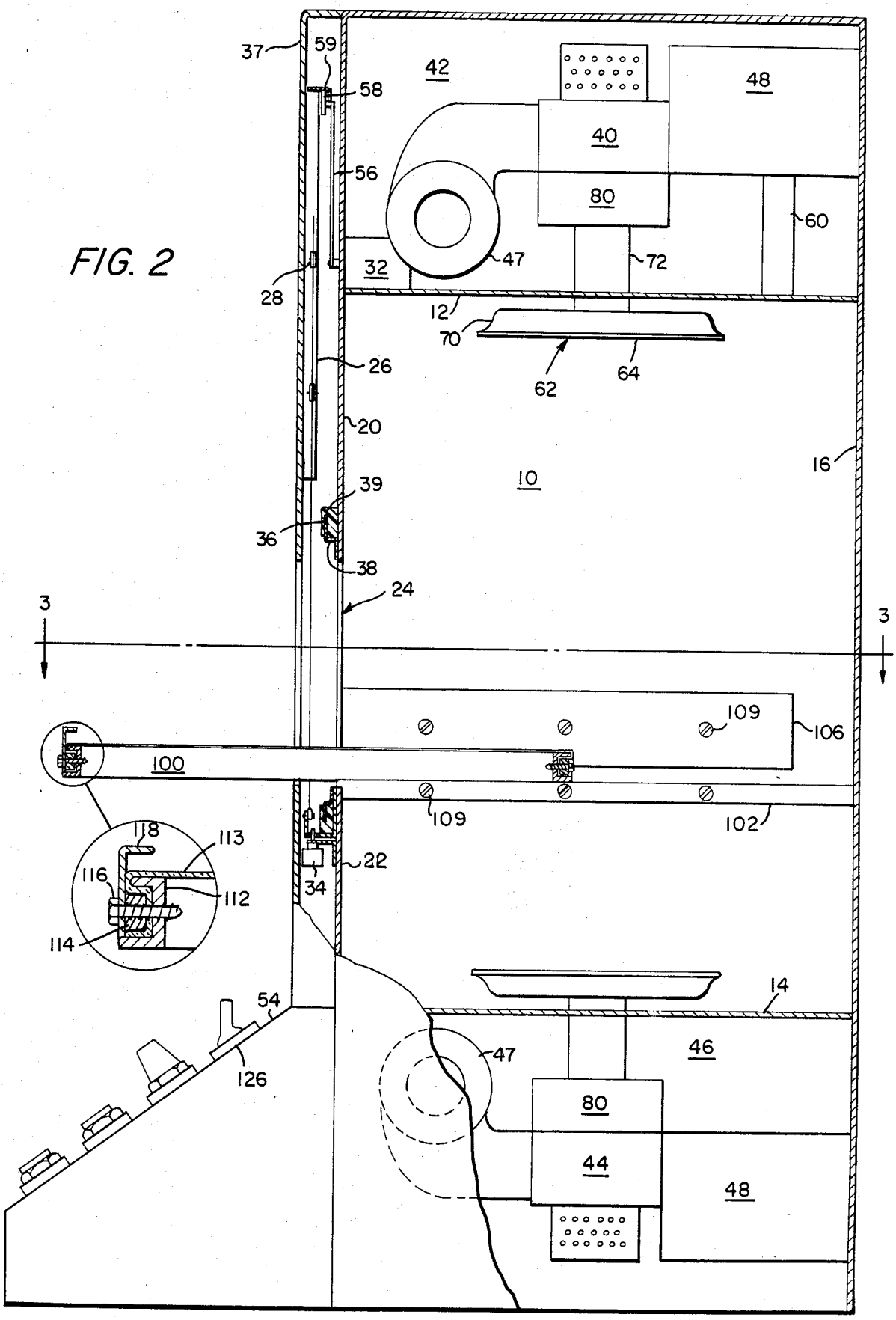
FIG. 2 is a side elevation partially cut away of the oven of FIG. 1 showing the product support tray in its extended position.

Referring to FIGS. 1 and 2, there are shown respective drawings of a batch type microwave oven in front and side elevations, both partially cut away. Microwave cavity 10 is formed in part by conductive metal surfaces 12, 14, 16, 18, 20, 22 and 23. An access aperture 24 is provided between surfaces 20 and 22. In operation, leakage of microwave energy through the access aperture is prevented by a seal formed in part by door 26. Although other types of conventional door seals could be used, FIGS. 1 and 2 show a door which opens vertically, guided by wheels 28 rolling on tracks 30. A motor 32 which is actuated by OPEN button 50 and CLOSE button 52 on control panel 54 causes arm 56 to rotate in 180° arc increments from top to bottom. On the axial end of arm 56 is a bearing 58 which makes contact under the lip 59 of door 26 thereby providing support for the door. In moving in the arc from its downward position to its upward position, the arm causes the door to open. Similarly, in moving in the arc from its upward position to its downward position, the arm causes the door to close. In the down position, the door depresses micro switches 34 which function as interlock switches to prevent operation of the microwave oven when the door seal is not properly positioned.

Surrounding access aperture 24 is the inner part of the microwave seal, the operation of which is described in detail in U.S. Pat. No. 3,767,884 to Osepchuk et al, assigned to the same assignee herein, which patent is hereby incorporated by reference. In brief, metallic fingers 36, which are connected to a bracket 38, extend outwardly from the access aperture. The preferred dimensions of these fingers may vary as a result of a dielectric loading material which may be used to encase the fingers to prevent the buildup of particles in the gaps between the fingers. The dielectric material forming plates 39 on both sides of the fingers of the preferred embodiment was polypropylene. The gaps between the fingers serve to substantially prevent the propagation of energy in the peripheral mode. Bracket 38 has a formed bend to provide a surface to attach the bracket to the oven cavity surfaces; spot welding or screws may be used. In the closed position, the door substantially eliminates leakage of microwave energy from the microwave cavity. Preferably, in the closed position, the gap between the door and the fingers is one thirty-second of an inch plus or minus one thirty-second. The thickness of the polypropylene covering the finger was approximately one thirty-second of an inch. Cover 37 is shown only in FIG. 2; it is provided for operator safety as well as asthetics.

Although microwave energy may be introduced into cavity 10 by any conventional means, the invention is used to best advantage in a system employing both top and bottom feeds. Referring to FIG. 2, magnetron 40 is shown in top enclosure 42 above the cavity and magnetron 44 is shown in bottom enclosure 46 below the cavity. The magnetrons provide output power at a frequency of 2450 megahertz. Each magnetron is cooled by air being blown through its fins by blowers 47, the exhaust air being channeled out of the respective enclosures by ducts 48. The duct in top enclosure 42 is coupled to cavity 10 by pipe 60 which by venturi effects provides an exhaust draft for effluents from cavity 10 resulting from microwave processing. The intake air for cavity 10 may be provided by any suitable means.

Positioned in cavity 10 are microwave energy feed structures 62 comprised of flat plate structures 64 having slots 66 therein through which microwave energy radiates into the cavity. A microwave feed cavity 68 formed by dish 70 positioned adjacent to plate 64 is supplied with microwave energy by coaxial line 72 whose outer conductor 74 is fixed with respect to the cavity and whose inner conductor 76 extends outside the cavity to a motor 78 which rotates feed structure 62 about an axis concentric with coaxial feed.

Outer conductor 74 of coaxial line 72 is connected to waveguide 80 while inner conductor extends through the waveguide to feed microwave energy from the waveguide through the feed structure into the cavity. The waveguide is supplied with microwave energy from magnetrons 40 and 44.

As shown in FIG. 1, impedance matching structures 82 and 84 around coaxial feed provide transitional impedance matching between the waveguide 80 and the coaxial line 72 and between the coaxial line 72 and the feed structure 62. Structure 82 also acts with conductor 76 as a choke to prevent microwave energy from leaking out toward motor 78.

Figure 3:
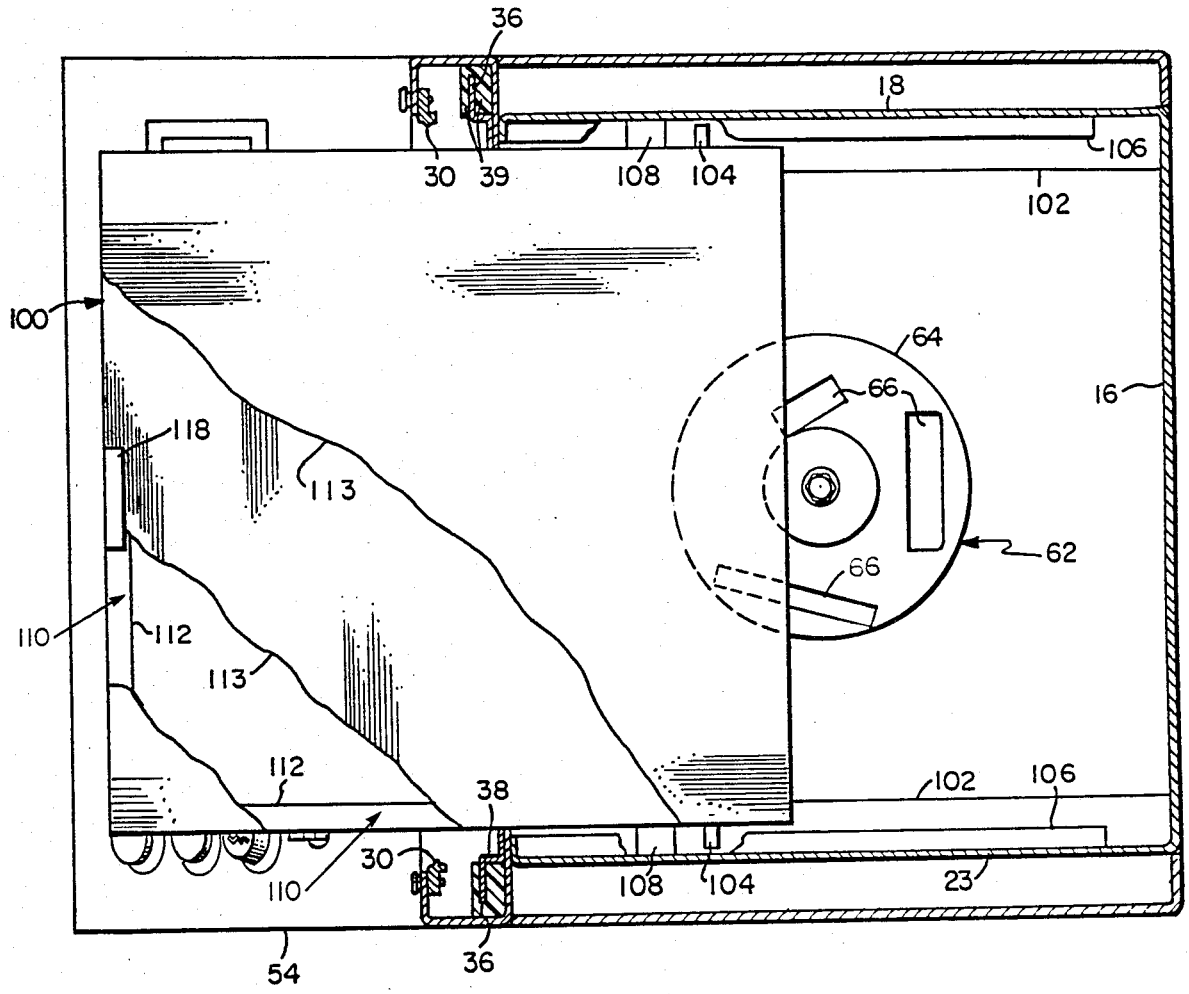
FIG. 3 is a cut away view along line 3—3 of FIG. 2 showing the tray in its extended position.

Slots 66 are radiating antennae, also referred to as radiating ports, positioned at different distances from the axis of rotation of structure 62 and are shown in FIG. 3, for example, as three openings oriented on different radii from the axis. The power radiated from each slot is depended on the dimensions of the slot and various desired patterns can be achieved by selecting the slot width. Dish 70 is formed so as to provide individual waveguide type channels from the center junction at matching structure 84 out to the respective slots.

In operation, product, and particularly rubber, which is to be processed, is placed on a tray 100 which is supported in the oven cavity 10 by support rails 102. Tray 100 may be pulled partially out of oven cavity 10 on the support rails to facilitate the easy loading and unloading of product. When in the extended position, as shown in FIGS. 2 and 3, the tray is prevented from tilting forward by pins 104 which extend underneath the guide rails 106. Further, stop plugs 108 in the pin slide paths prevent tray 100 from being pulled completely out of cavity 10. To remove the tray from the oven, the tray is pushed to the backward position where pins 104 are permitted to be raised above guide rails 106 which do not extend to rear wall 16 as shown in FIGS. 2 and 3. Preferably, support rails 102 and guide rails 106 may be fabricated of polypropylene which provides a smooth sliding surface. These rails may be connected to the side walls of cavity 10 by screws 109 as shown in FIG. 2.

Tray 100 comprises a rigid frame 110 over which is attached a flexible, thin material such as commercially available Teflon coated Fiberglas. Specifically, that may be a glass fiber layer covered with polytetrafluorethylene or a synthetic resin polymer material. Although other types of frame structures may be used, the one described herein comprises four C-shaped metallic channels 112 which are welded at their ends to form a rectangular frame with the open part of the C outward as shown in FIGS. 1 and 2. Typically, the channels would be fabricated of aluminum because of its light weight. Although metallic bodies in a microwave cavity often cause anomalies in the microwave energy distribution, it was found that these metallic members adjacent to the walls caused no arcing and did not substantially interfere with the expected pattern of power.

Teflon coated Fiberglass sheets 113 were cut and positioned across the rectangular rigid frame along both axes as shown in FIGS. 2 and 3. The ends of the sheets are wrapped into the opening as shown in expanded view of FIG. 2 and held in place by metallic bars 114 which are connected to channels 112 by screws 116. The bars may be removed and the sheets replaced if damaged. In the front of tray 100, handle 118 was positioned to provide for sliding the tray in and out of cavity 10.

Supporting the product on a thin microwave transparent surface such as the Teflon coated Fiberglass sheets described herein provides a significant advancement in microwave processing. More specifically, it was found that the top to bottom energy distribution in the product in this cavity, fed at top and bottom, was far more symmetrical than that available using prior art systems. The deleterious transformer impedance characteristic of prior art support structures was substantially reduced so as to provide a more uniform profile of heat through the product. The combination of both sheets is less than one-eighth inch. Furthermore, the other preferable requirements described in the background herein were also achieved. Specifically, the tray's mechanical characteristics are compatible with an industrial processing environment. More specifically, the tray is resistant to shock of being dropped or impact loaded; it is immune to temperatures up to 400° F.; it can sustain higher temperatures without giving off toxic by-products and; it is light and easy to handle. Also, the tray satisfies constraints of microwave processing by not exhibiting transformer impedance characteristics. Also, the tray is relatively inexpensive to produce and is easily repaired or replaced.

An automated control panel 54 is shown in FIG. 2. It may be used to advantage but is not necessary for the teaching of the invention. For example, process times may be programmed by digital switches 120 which are selected by product switches 1 through 8. More specifically, product 1 switch may correspond to individual switches 121, 122 and 123 which may represent 0.50 minutes of processing time. Therefore, the depressing of switch 1 would cause 30 seconds of product processing. Display P indicates the product type being processed. PRESET TIME is a digital readout to show the time for processing of which the ELAPSED TIME is shown as indicated. Control switch 126 provides for resetting the door interlock. Key switch 128 provides a means for locking the operation of the microwave oven. Buttons 130 and 132 provide for manual operation of microwave power and an emergency off, respectively.

This concludes the description of the preferred embodiment. The reading of this embodiment will bring to mind many modifications and alterations to one skilled in the art without departing from the spirit of the invention. Therefore, it is intended that the scope of the invention be limited only by the appended claims.

What is claimed is:

1. In combination:

a microwave oven cavity having an access opening;

means for energizing said cavity with microwave energy;

a door for preventing the escape of said microwave energy through said access opening;

a product support tray suspended horizontally in said cavity;

said tray comprising a rigid border frame substantially conforming to the shape of said oven cavity in a horizontal plane; and said tray further comprising a thin flexible microwave transparent sheet suspended across and attached to said rigid frame to provide the product support surface of said tray.

2. The combination in accordance with claim 1 wherein said sheet comprises glass fibers covered with synthetic resin polymer material.

3. The combination in accordance with claim 1 wherein said frame comprises aluminum.

4. In combination:

a microwave oven cavity having an access opening;

means for energizing said cavity with microwave energy;

a door for preventing the escape of said microwave energy through said access opening;

a product support tray held in an elevated horizontal position in said cavity by support means;

said tray comprising a rigid border frame; and said tray further comprising a thin flexible microwave transparent material suspended across said frame to provide the product support surface of said tray.

5. The combination in accordance with claim 4 wherein said material comprises glass fibers covered with a synthetic resin polymer substance.

6. The combination in accordance with claim 4 wherein said frame comprises aluminum.

7. The combination in accordance with claim 4 wherein said frame substantially conforms to the shape of said oven cavity in a horizontal plane.

8. In combination:

a microwave oven cavity having an access opening;

means for energizing said cavity with microwave energy;

a door for preventing the escape of said microwave energy through said access opening;

a product support tray suspended horizontally in said cavity;

said tray comprising a rigid frame having four elongated members with ends connected to form a rectangular shape; and said tray further comprising a sheet of microwave transparent material having a thickness of less than one-eighth inch covering said frame, said sheet being attached to two of said members that are parallel.

9. The combination in accordance with claim 8 wherein said sheet comprises glass fibers and a layer of synthetic resin polymer material.

10. The combination in accordance with claim 8 wherein said frame comprises aluminum.

11. The combination in accordance with claim 8 wherein the outer periphery of said frame substantially conforms to the dimensions of the cavity in a horizontal plane.

12. The combination in accordance with claim 8 further comprising a second sheet of microwave transparent material covering said frame, the total thickness of said sheet and said second sheet being less than one-eighth inch.

13. In combination:

a microwave oven cavity having an access opening;

means for energizing said cavity with microwave energy;

a door for preventing the escape of said microwave energy through said access opening;

elongated microwave transparent support rails connected to the side walls of said cavity in a horizontal direction;

a product support tray positioned on said support rails and supported thereby;

said tray comprising a rigid border frame; and said frame further comprising a thin flexible microwave transparent material suspended across said frame by attachment thereto, said material providing the product support surface of the tray.

14. The combination in accordance with claim 13 wherein said material comprises glass fibers and a synthetic resin polymer substance.

15. The combination in accordance with claim 13 wherein said frame comprises aluminum.

16. The combination in accordance with claim 13 wherein said support rails comprise polypropylene.

* * * * *